United States Patent [19]

Mroczkowski

[11] 4,336,831

[45] Jun. 29, 1982

[54] TOOL

[76] Inventor: Zbigniew Mroczkowski, Tristramweg 17, Berchtesgaden-Stanggass, Fed. Rep. of Germany, 8240

[21] Appl. No.: 176,847

[22] Filed: Aug. 11, 1980

[51] Int. Cl.[3] ..... B27C 9/00

[52] U.S. Cl. ..... 144/2 R; 83/916; 144/218; 144/363; 407/13; 407/63; 409/293; 145/116 R

[58] Field of Search ..... 83/916, 663, 672, 680; 409/293, 228; 145/116 R; 144/2 R, 134 R, 136 R, 218, 323, 134 A; 407/12, 13, 57, 62, 63

[56] References Cited

U.S. PATENT DOCUMENTS

| | | | |
|---|---|---|---|
| 1,881,705 | 10/1932 | Lapointe | 407/13 |
| 2,629,113 | 2/1953 | Chafins | 145/116 R |
| 3,117,366 | 1/1964 | Castor, Sr. | 407/63 |
| 3,209,800 | 10/1965 | Leibow | 409/228 |
| 4,249,309 | 2/1981 | Karr | 83/916 |

FOREIGN PATENT DOCUMENTS

| | | | |
|---|---|---|---|
| 639667 | 2/1979 | U.S.S.R. | 407/13 |

*Primary Examiner*—W. D. Bray

*Attorney, Agent, or Firm*—Merriam, Marshall & Bicknell

[57] ABSTRACT

A machine and a tool for cutting material such as wood and plastics. The tool includes a shank adapted to be fastened to and rotated by a power driven spindle. The tool further includes a cutting part having at least one spiral rib on its outer periphery. The outer periphery of the rib is sharpened on its edge which is adjacent the shank, and the spiral rib has a pitch in the range of approximately 5° to 15°. The machine includes the tool, a drive motor and the spindle, and a support table for supporting a workpiece. The table has an opening formed in it and the tool extends through the opening. The sharpened edge of the rib is adjacent the table.

8 Claims, 15 Drawing Figures

C

A - B

A
B
C 49
48
59
8
62
1
60
10
9
58
5°-15°
57
46

TOOL

The invention relates to a device for treating, more particularly by cutting or grooving or smoothing, workpieces of wood, plastics, brass, aluminum and other readily machinable substances, the tool having as its cutting element a rotating coil which co-operates with a workpiece support disposed at one end of the coil and rigidly disposed on the tool.

People with home workshops, modellers and "do-it-yourself" enthusiasts need a large number of appliances for accurate and difficult work. Apart from lathes, the devices mainly required are machines adapted to cut, saw, mill and smooth.

The tools used to cut workpieces are circular saws, band saws, keyhole saws, fret saws and the like which are all sawing tools—i.e., consecutive sharp teeth of a cutting tool cut away the material of the workpiece in a narrow slot. Only narrow band saws or compass saws or fret saws can be used if curved cuts are required. Continuously curved cuts of narrow radii of curvature are difficult to contrive with reciprocating saws and band saws. In the case of fret saws and band saws the size of the article to be sawn is restricted by the fret saw frame or by the return run of the cutting band. Also, the only tools of those mentioned which can be used to cut straight grooves are circular saws. Circular saws are extremely dangerous to the user and the risk is even greater with small workpieces.

It is also known to use milling tools and elaborate tool or workpiece guides to devise straight or curved profiles, slots and grooves in workpieces, the cutting forces of the miller acting on the workpiece mainly in the peripheral direction of the miller; consequently, the workpiece experiences forces which are operative perpendicularly to the mill axis which make it necessary to clamp the workpiece tightly or, if the material being worked is of very reduced strength, to provide at least a firm guide for the workpiece by means of an abutment or the like. Only at very high tool speeds, for instance, in top milling for woodworking, is a freehand cut sometimes possible; unfortunately, this is not only very dangerous and requires an elaborate protection, but is also very noisy and, because of the very reduced advance per revolution of the mill causes considerable dust.

The treatment of plastics, more particularly thermoplastics, makes heavy demands on tools as regards cutting speed, cutting properties, advance and so on, and so the same equipment can seldon provide satisfactory results for both wood and plastics. Rough surfaces are unavoidable in sawing and require subsequent smoothing either laboriously by hand or by means of an appropriate machine. Elaborate shapes cause severe problems. The known high-speed wood planers are rarely usable on plastics and are useless even for very low-strength metals. Also, they can cope only with straight or slightly curved surfaces. Another disadvantage, whether they are hand-held or table tools, is that the smaller the workpiece, the more dangerous is the tool to handle.

Only a small number of special appliances can comply with the general requirements of the users concerned for maximum accuracy and the ability to deal with workpieces made of a variety of substances. A band saw or fret saw cannot cut an accurate circle or circle segment within tolerances of ±0.1 mm, apart from the need to smooth the cut surface, even when the available accessories are used. A milling machine must be used to produce small strips or similar parts of wood and plastics to width and thickness tolerances of ±0.1 mm. Similar cosiderations apply to other shaping work, grooving work and so on.

It is the object of the invention to provide a cutting tool and a corresponding appliance for machining parts, e.g. in modelling, toy making and to some extent in furniture making, the parts being made of materials such as wood, plastics, low-strength metal, plaster board and the like, the tool acting on the sawing principle by applying cutting or chip-removing forces to the workpiece, such forces extending parallel or substantially parallel to the tool axis so that a free cut which can be guided by hand and which can be straight or curved at choice can be made but without the disadvantage of the continuous or reciprocating motion of sawing and without the disadvantage found in known milling are forces acting one-sidedly on the workpiece in the peripheral direction of the cutting tool. All the workpieces to be dealt with can be machined by the same cutting tool. The cutting tool can perform with equal satisfaction all operations such as cutting (instead of sawing, milling and smoothing (instead of planing) with considerably less risk of injury, at least in partial regions, than is present with the conventional sawing tools. Also, to facilitate use of the tool and device in the home, the noise caused by the device, the noise resulting from treating the workpiece and the dust evolved, more particularly in woodworking are reduced very considerably.

In accordance with the invention, therefore, the coil is a single-start or multi-start worm of such a fine pitch that the forces transmitted to the workpiece by the tool during cutting extend substantially parallel to the tool axis towards the workpiece support.

Preferably, the worm pitch angle is from 5° to 15°.

The result of the small pitch angle is that the cutting action is operative substantially parallel to the tool axis towards the stationary support, with a very considerable reduction in the considerable lateral drift common with tools where the direction of force in milling extends substantially in the peripheral direction and increases correspondingly with increasing strength of the material being machined.

Since the feeding movement between the material and the tool is to be effected manually, the force required is correspondingly reduced. This force is determined, disregarding the strength of the material being machined, by the cross-section of the surface to be machined, such surface resulting from workpiece thickness and tool diameter. Tool diameter is therefore very small, preferably 6 mm or less, more particularly for parting-off work, to achieve a very reduced feeding force and a very reduced wastage of material.

Preferably, hard metal is the material used for the tool. Optimum results have been obtained using hard metal tools with diameters of from 2.5 to 6 mm, a coil pitch of less than 2 mm, actually 1.8 mm and a feed rate of 0.1 mm per tool revolution. A coil pitch of 1.8 mm ensures that when thin workpieces, more particularly sheet material, of only 2 mm thickness is being worked, a cutting edge of the cutting tool is always in engagement with the workpiece, thus ensuring smooth jerk-free cutting. More particularly, the following thicknesses of material can be parted off without risk of cutter breakage:

Cutting tool-dia. mm: 2.5, 3.0, 4.0, 5.0, 6.0

Material thickness, approx. mm: 5, 8, 13, 25, 40

These values are for woods (e.g. spruce, Scotch fir, larch, beech, oak), hard fibre boards, plywoods of various grades and plastics (e.g. hard PVC, Delrin).

Since the cutting tools just referred to had a standard coil pitch of 1.8 mm, their pitch angles were as follows:

Cutting tool-dia. mm: 2.5, 3.0, 4.0, 5.0, 6.0

Pitch angle approx.: 12°40′ 11° 8° 6°30′ 5°30′

Workpiece drift due to the cutting force produced by a cutting tool in accordance with the invention of 4 mm diameter and 1.8 mm pitch, corresponding to a pitch angle of approximately 8°, was compared to the corresponding drift when known milling tools were used. The term "drift" denotes the force which is transmitted to the workpiece perpendicularly to the cutting tool axis. The drift of a workpiece machined with a cutting tool in accordance with the invention is only from 15 to 20% of the figure found with a conventional mill having a pitch angle of 45°. Clearly, therefore, the tool in accordance with the invention makes it possible to make freehand cuts with virtually negligible force needed for tool positioning, as compared with when conventional mills are used.

The cutting of figures and other parts out of plywood of up to approximately 6 mm thickness, such as printed originals for model work, can be carried out very satisfactorily by a cutting tool in accordance with the invention of approximately 2.5 mm diameter and a 1.8 mm pitch, whereas a tool having a diameter of 5 mm and an operative length of approximately 30 mm is best for general use and cuts in solid material up to a thickness of approximately 25 mm.

A conical cutting tool having, for instance, a shank diameter of 6 mm and a diameter at its top end of 2 mm makes a universal cutting tool with which there is virtually no risk of breakage and which can cut workpieces up to a thickness of approximately 40 mm at a reduced rate of feed. When the cutting tool is retracted into the hollow spindle of the drive unit, thin panels or the like can be cut with minimum wastage since the cutting is performed by the thin tip of the cutting tool. In the case of thick workpieces considerably less material must be removed in the top part of the tool than in the bottom part so that tool loading and the force required to feed the tool are reduced. The pitch of such a tool is preferably less than 2 mm, e.g. 1.8 mm. To ensure that the edge of the cut is not skew, the spindle of the driving appliance can be inclined by the corresponding angle, in which event an inclined cut surface is produced only on the waste side.

The cutting force which the low-pitched coil in accordance with the invention applies to the table has the advantage of preventing the workpiece from drifting accidentally during machining. Also, this property can be used with advantage to produce geometrically satisfactory straight cuts; for instance, a workpiece support having a rough surface covering can be disposed on the table for rectilinear movement and the workpiece can be lined on the cover or support in accordance with the required cutting direction, held down with one hand and fed to the tool. During cutting the tool is pressed against its support at substantially the same cutting force and does not shift laterally, irrespective of whether the work being performed on the workpiece is parting-off or just smoothing or after milling.

The workpiece support of the device in accordance with the invention is preferably a flat table. If required, the angle between the worm axis and the main plane of the table can be varied by pivoting the tool or the table. The table is formed with a bore through which the free end of the worm extends, if required to an adjustable extent.

The workpiece can be guided readily into any cutting direction since the lateral drift is very reduced; in contrast to operation with band saws or fret saws, the workpiece does not have to be turned as cutting proceeds since the worm has the same cutting effect in all directions and so the workpiece has to be moved only along the X-Y axis. The workpiece can be of any length and width and there is no hindrance by the swing arm or the like, for instance, as with a fret saw.

The shaving action of the coil in accordance with the invention ensures that the treated surface has a high-quality texture, obviates the need for any after working after a cut in solid material—i.e., after a severance comparable to parting-off—yet enables dimensional corrections, if an appropriate auxiliary device is available, to be made to very small orders of magnitude down to a few hundredths of a millimeter. Cuts along a straight edge or abutment or circular cuts around a stationary journal or pin or the like can be made to accuracies previously obtainable only with metal working appliances, since the coil is much more rigid than a band saw or fret saw and deviates hardly at all in response to changing conditions of cutting, such as differences of hardness of a workpiece, graining of wood, variations in rates of feed and so on.

Another advantage of the low-pitch coil in accordance with the invention is that unlike bills and saws it cannot catch in the workpiece since its cutting action is continuous and not intermittent; consequently, an abrupt or jerky movement of the workpiece on to the tool does not give rise to any danger for the user. Cutting begins only when pressure is applied to the workpiece towards the coil, so that very delicate copying of shapes and stopping and restarting of the appliance in engagement are possible without any risk.

If the coil projects from the table beyond the thickness of the material, the excess length can be covered by a push-on protective cap, thus substantially obviating the risk of injury to slipping during manual feeding.

The cutting tool in accordance with the invention combines possibilities for which various kinds of saws and milling devices were previously necessary but is free from the disadvantages of the known tools. If guiding of the workpiece is required, e.g. for straight cuts or circular cuts, it is a very simple matter to arrange.

If the tool in accordance with the invention is used to mill or cut out figures from panels to templates, the coil can have at its free end or elsewhere a non-cutting zone via which the tool can be guided in or along a template.

The foregoing applies of course when the workpiece is stationary and the cutting tool in accordance with the invention is disposed in an appropriate holder or the like and is moved relatively to the workpiece.

The invention will be described in greater detail with reference to the drawings wherein.

Figure 1:
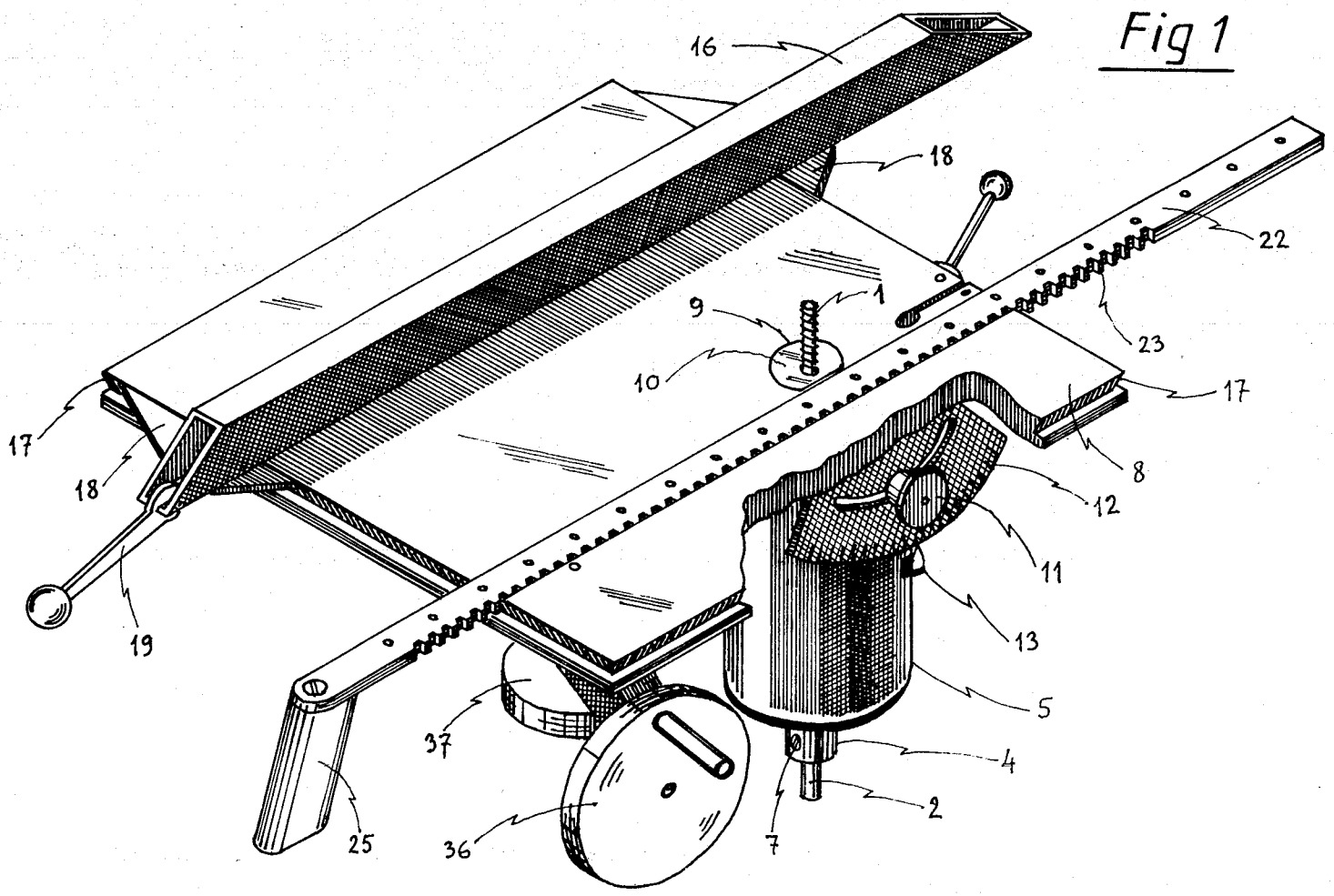
FIG. 1 is a perspective view of an embodiment of a device in accordance with the invention.
Figure 2:
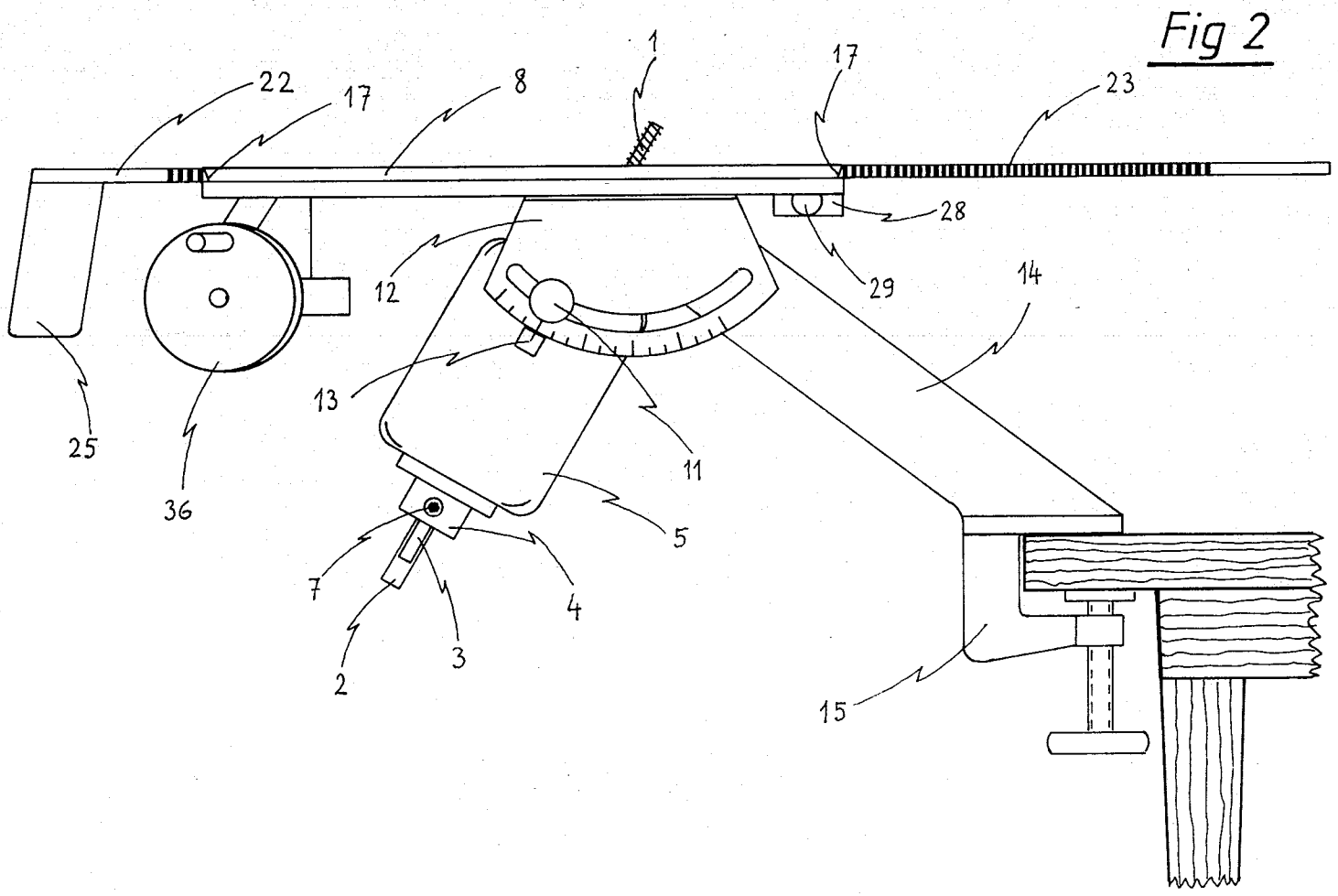
FIG. 2 is a side view of the device shown in FIG. 1 with the cutting tool set at an inclination.
Figure 3:
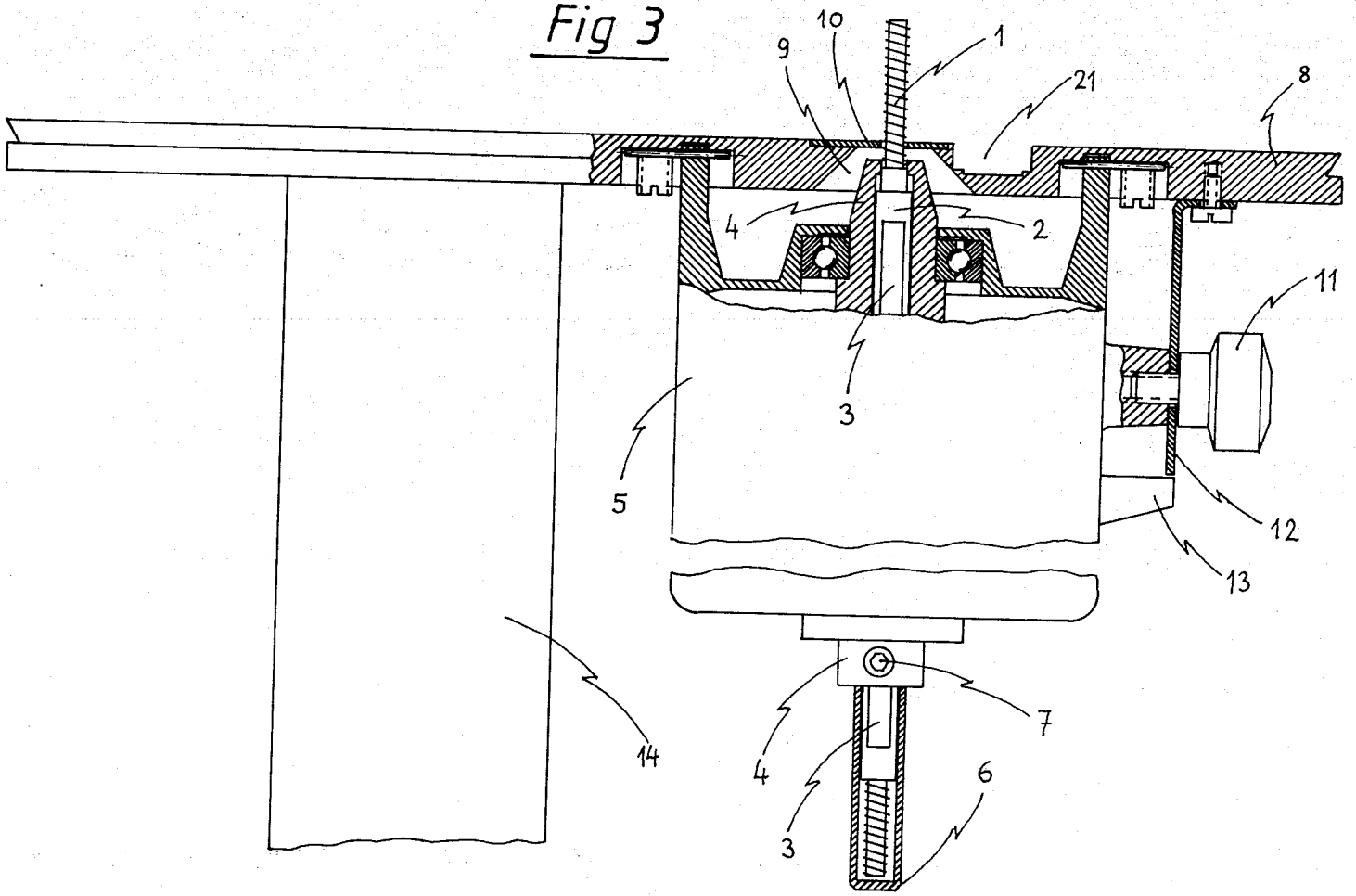
FIG. 3 is a partial section through the device near the drive unit.
Figures 4A, 4B, 4C:
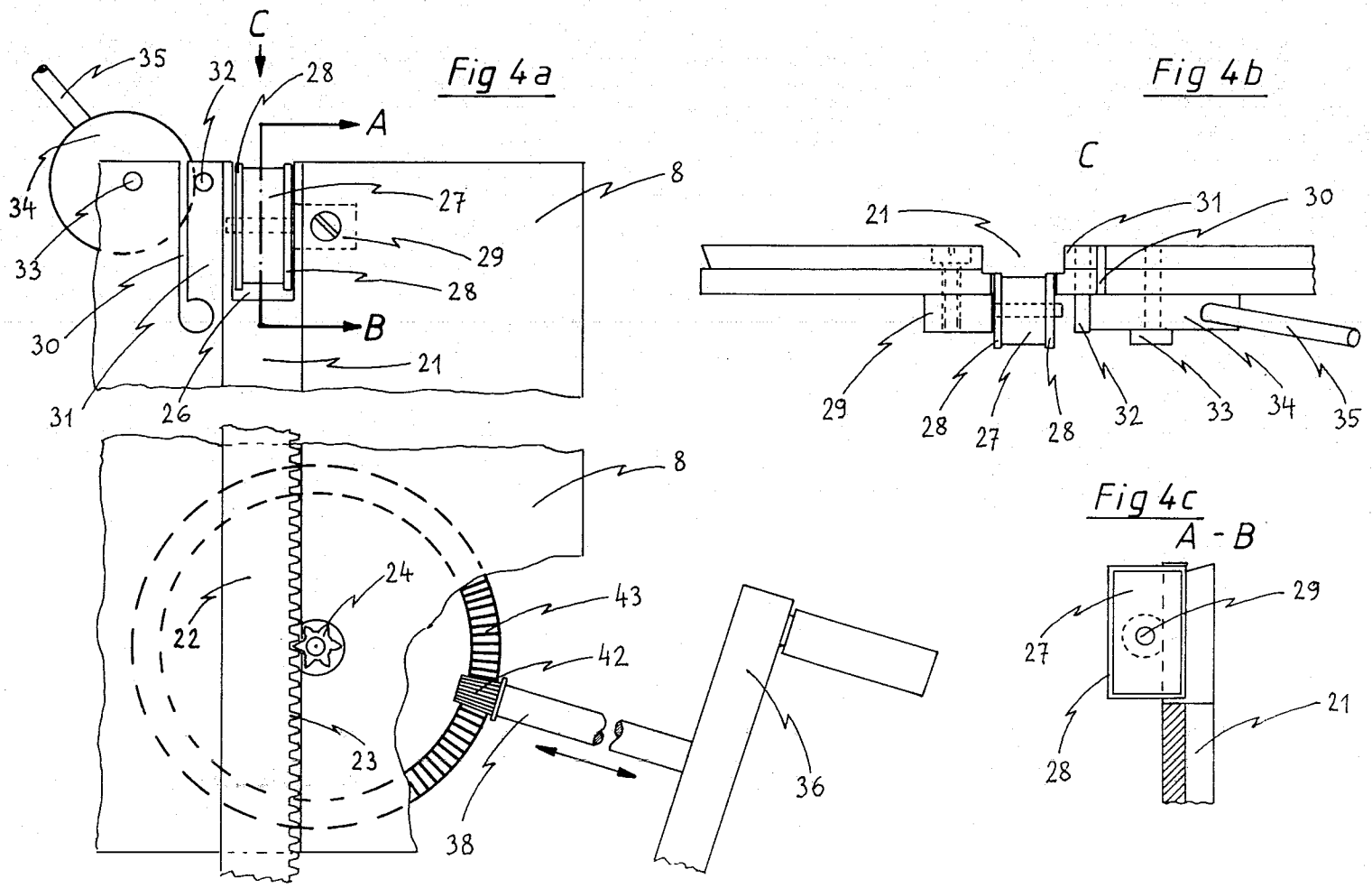
Figure 5A:
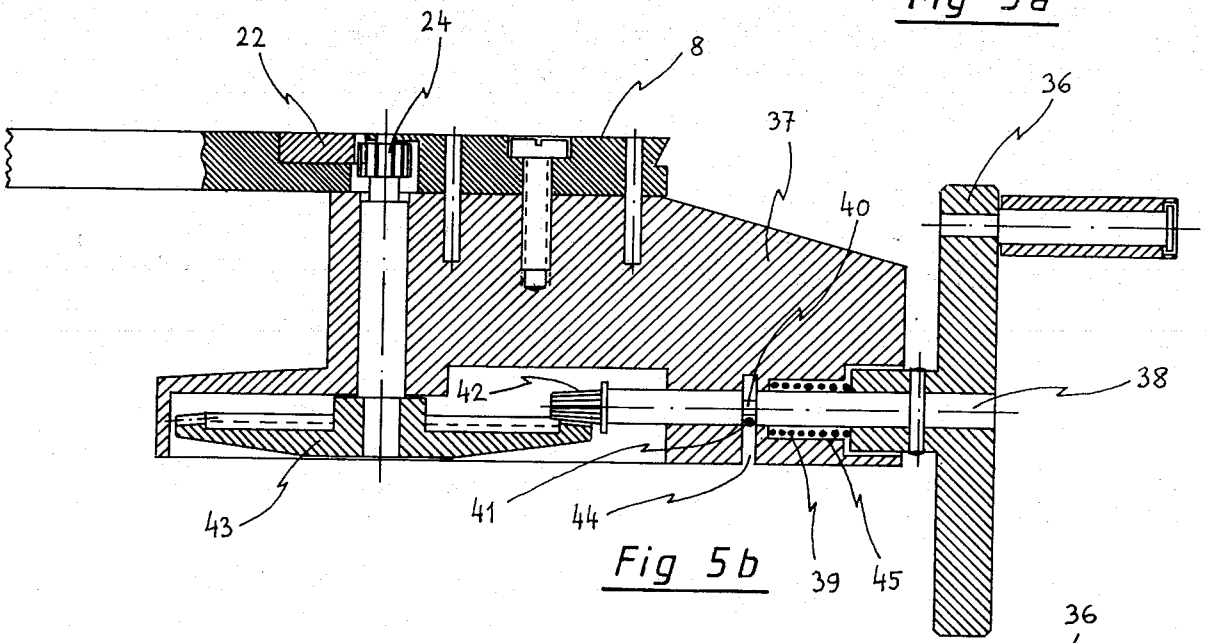
Figure 5B:
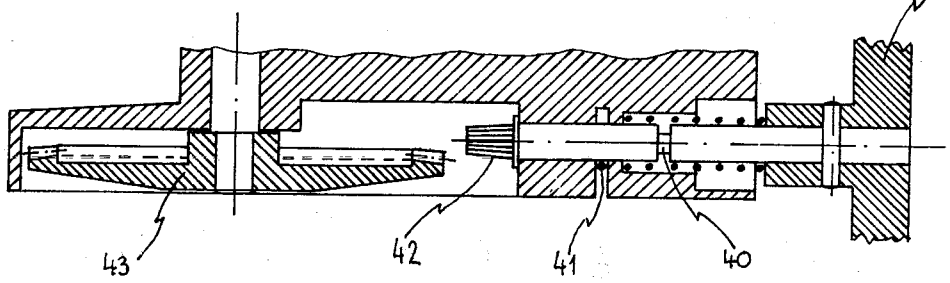

FIGS. 4*a* to 4*c* show the arrangement of a magnetic holding device and of a clamping device for the guide rod and the operation of the feed system of the device shown in FIGS. 1 to 3;

FIGS. 5*a* and 5*b* are views in section of the feed system of FIG. 4*a;*

Figure 6:
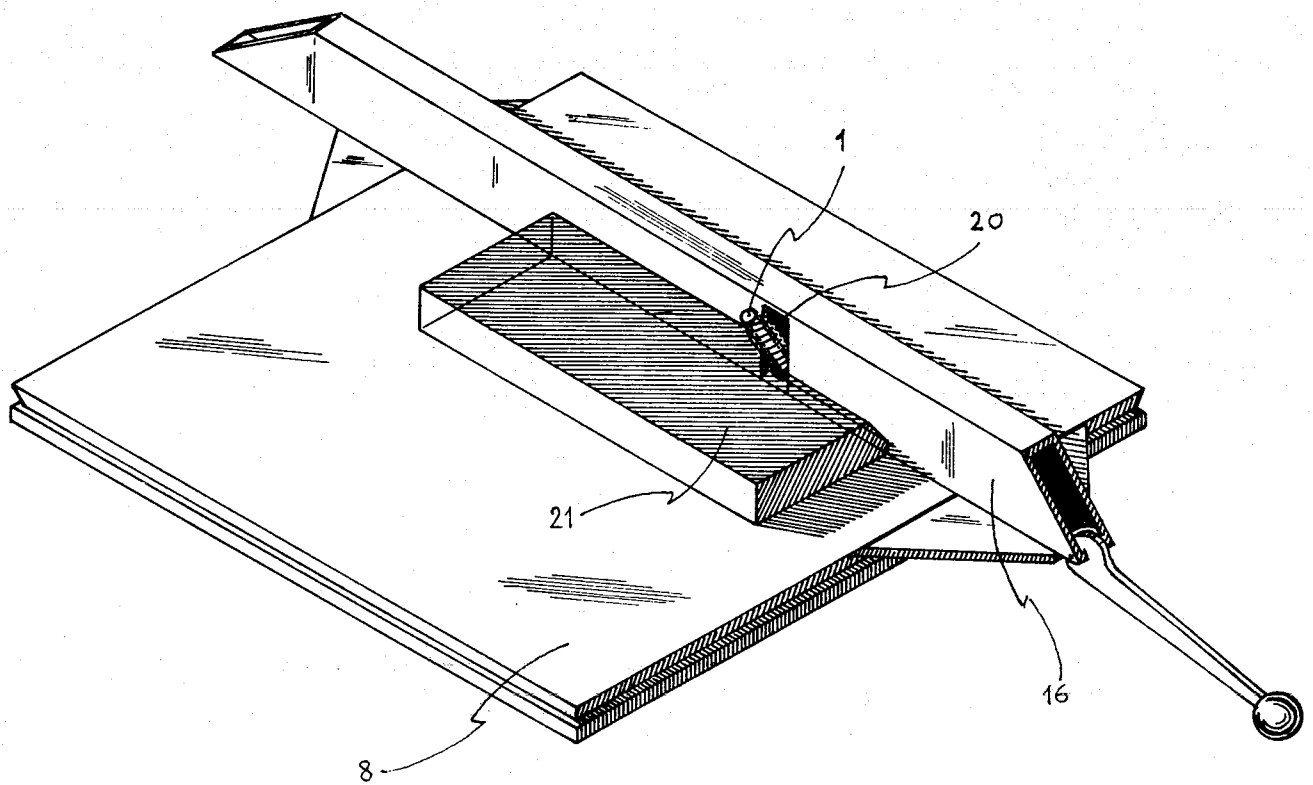
Figure 7:
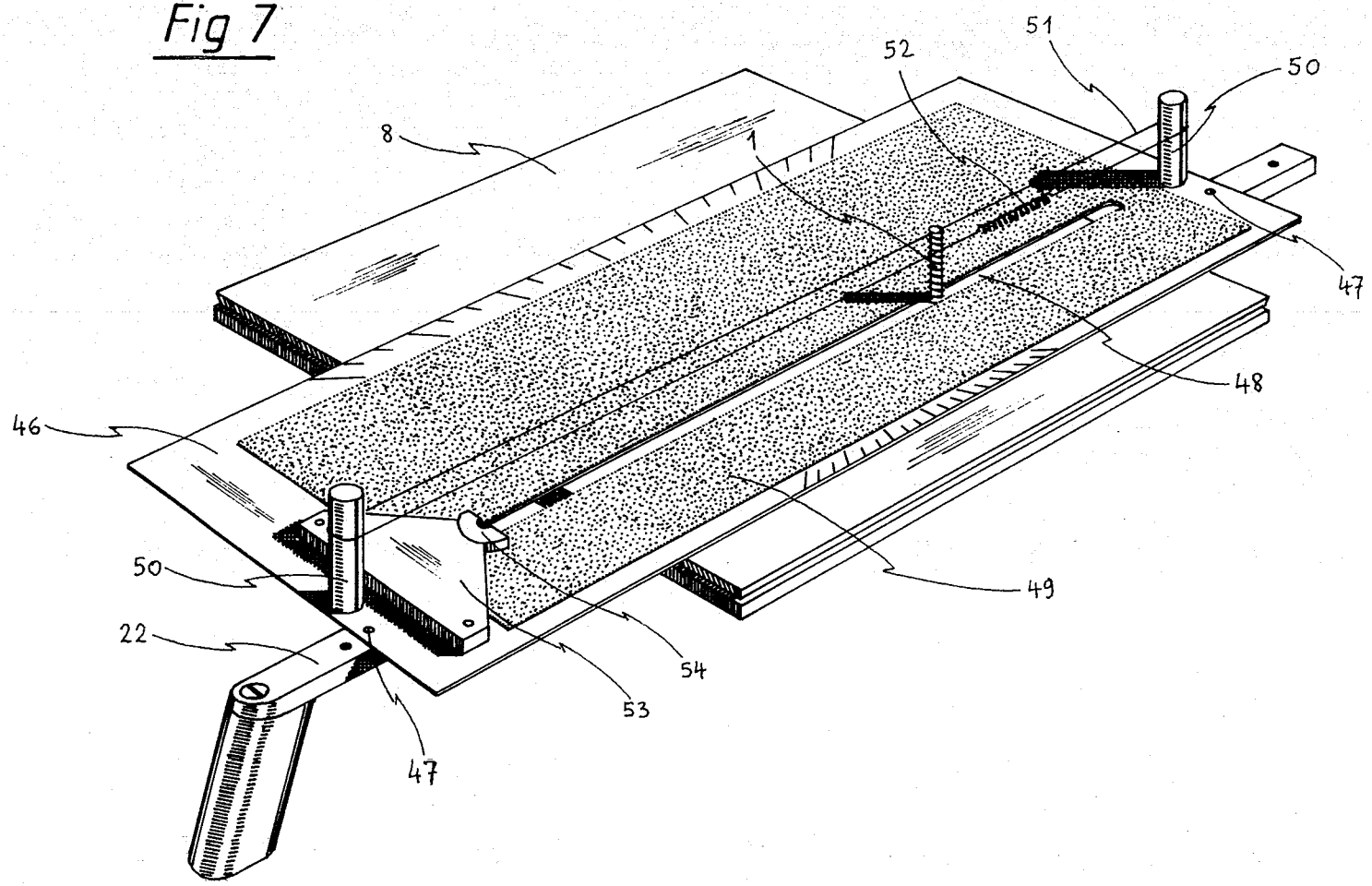
Figure 8:
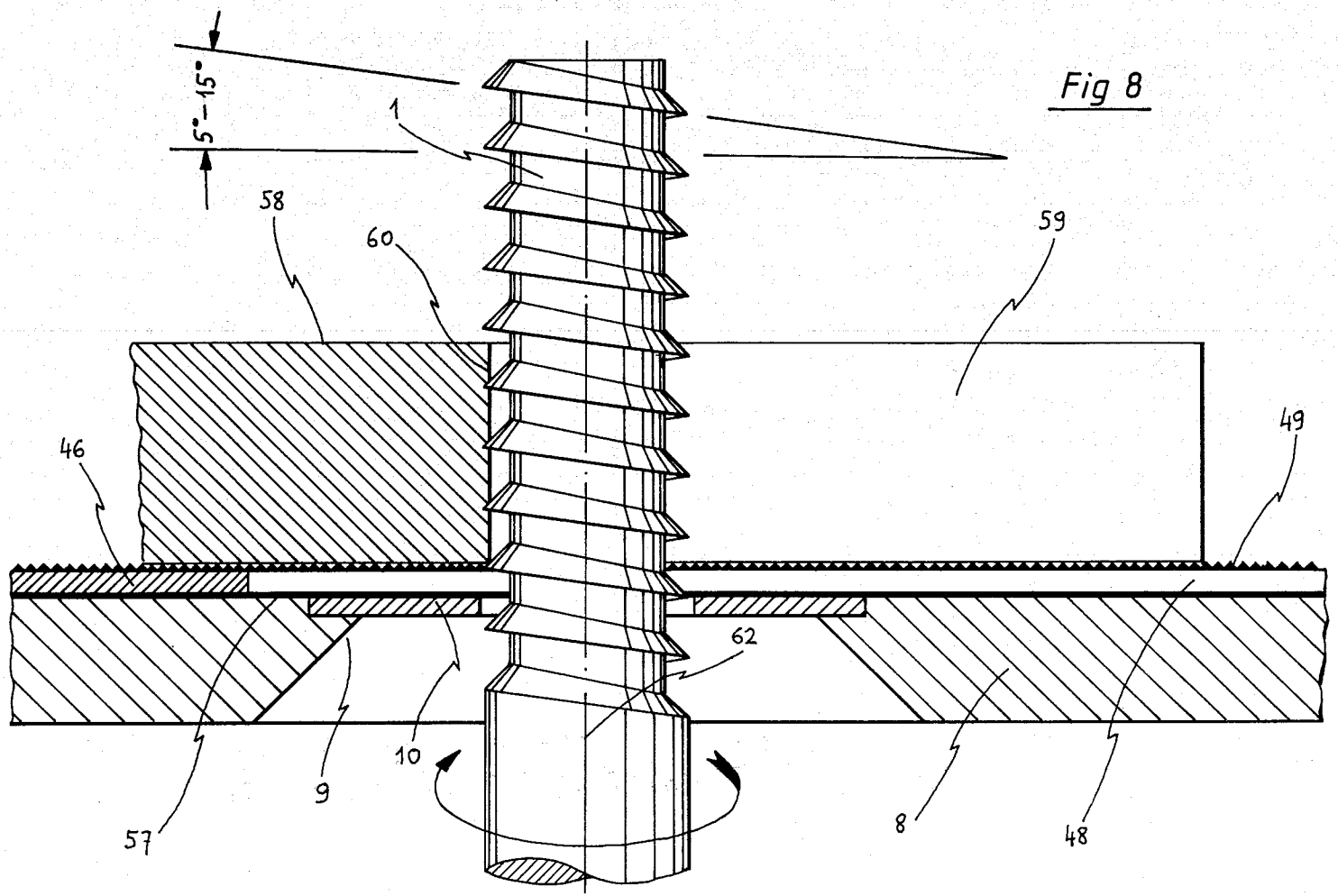
Figure 9:
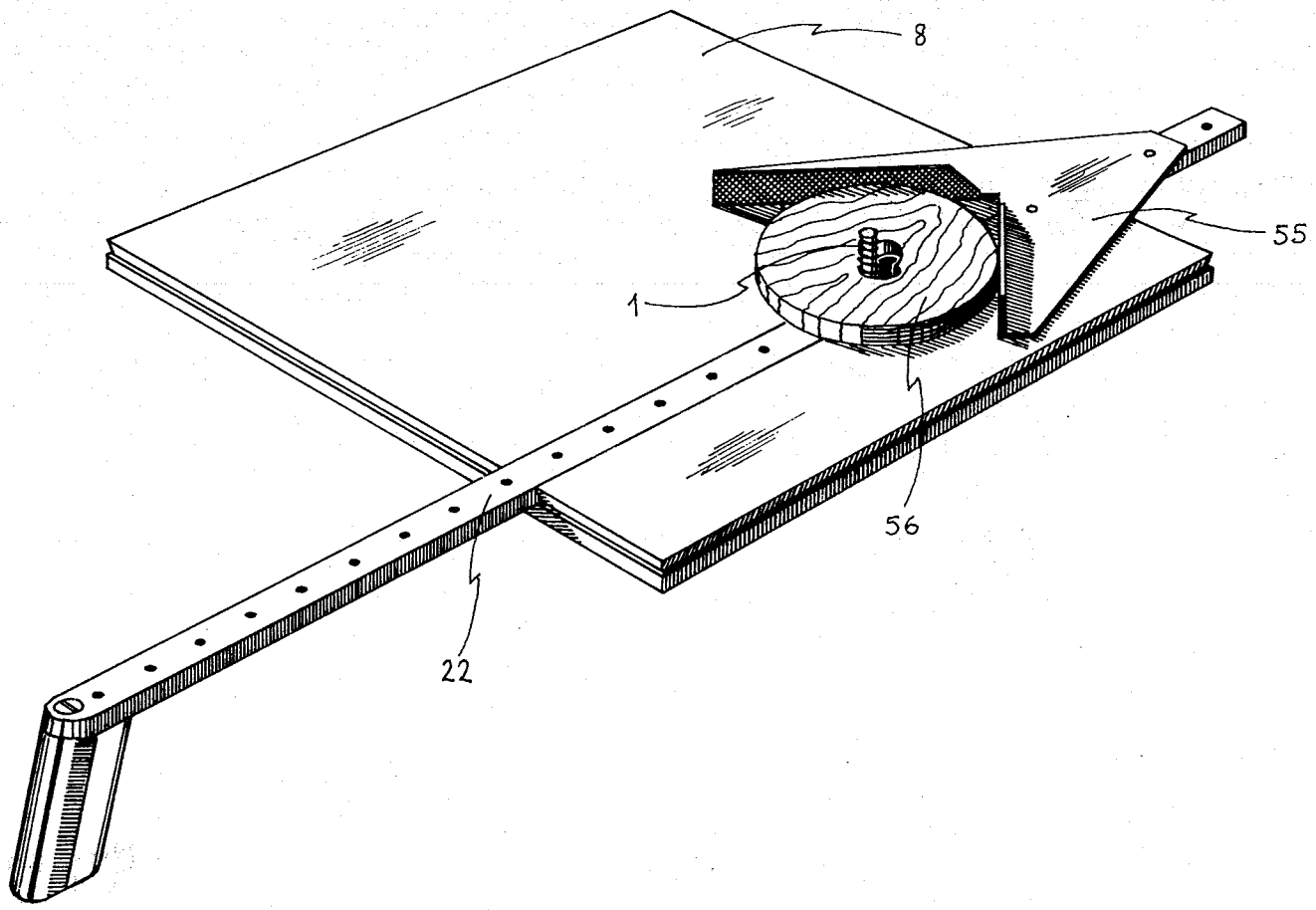
Figure 10:
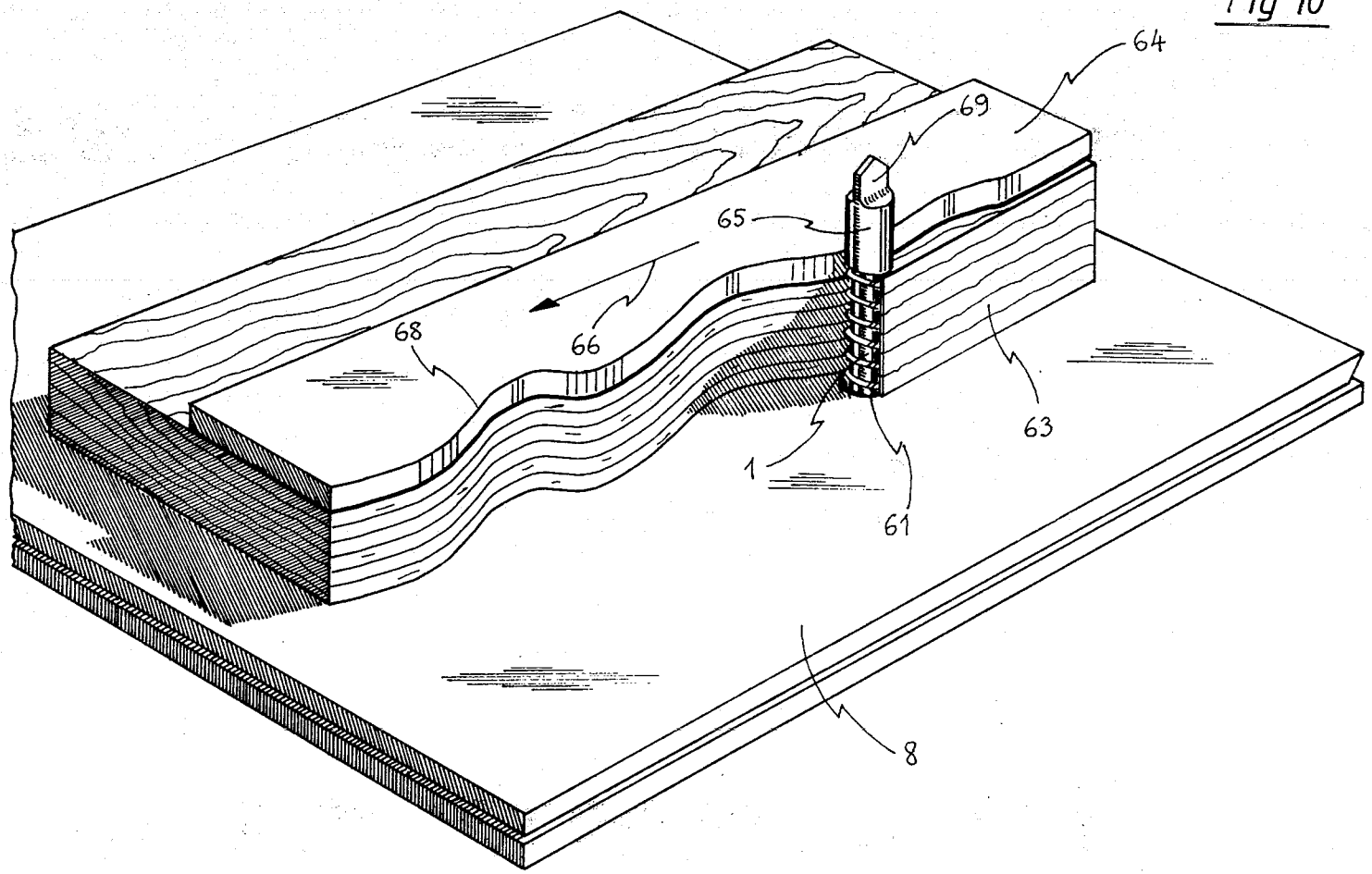
Figure 11:
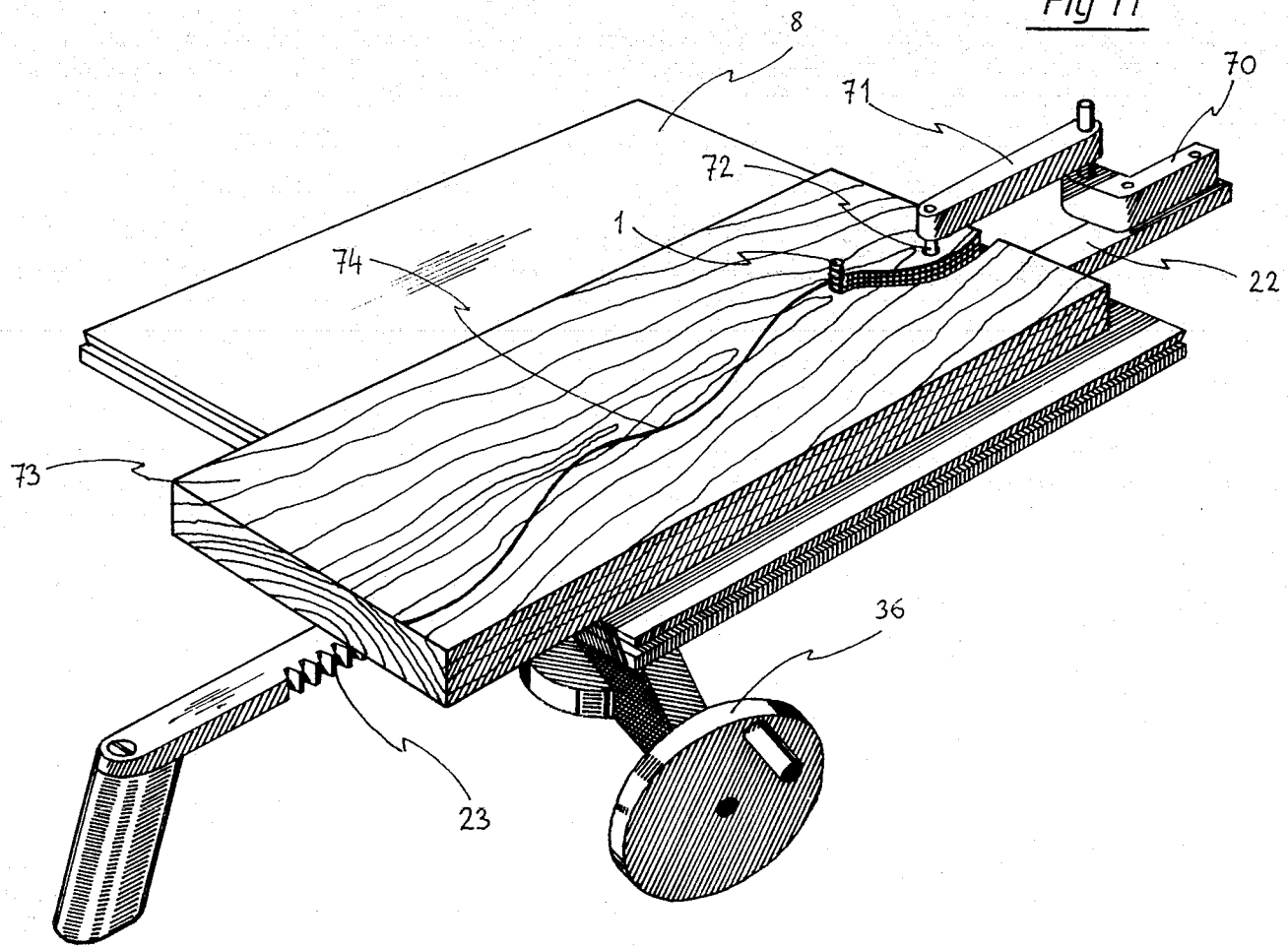
Figure 12:
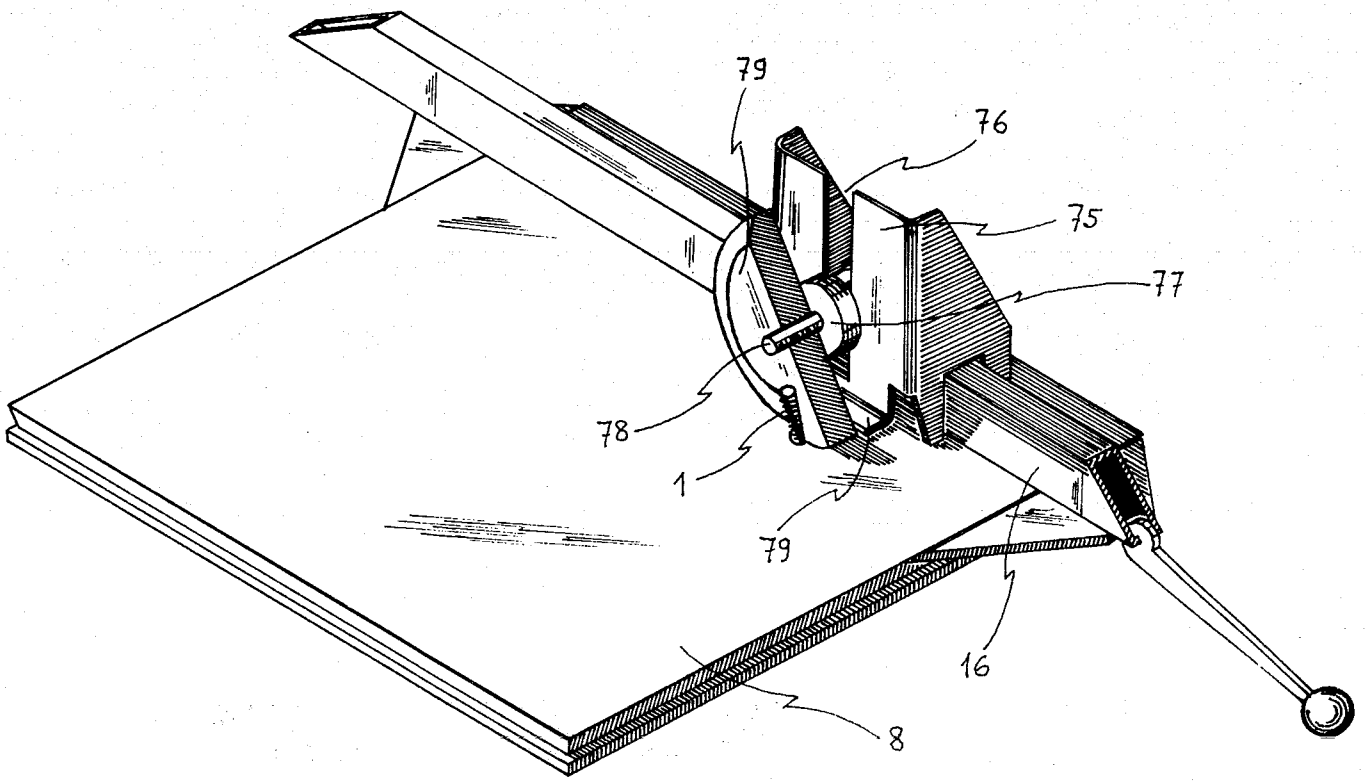
Figure 13:
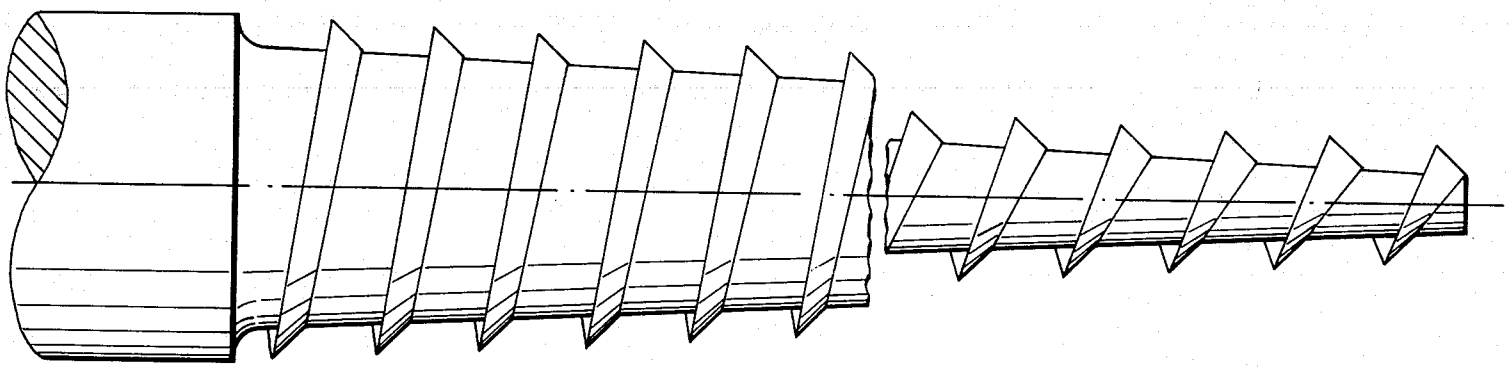

FIG. 6 shows the table of the device with the stop and the inclined cutting tool;

FIG. 7 is a perspective view of the device with a rough covering or surface movable on the table and an aiming aid and support device disposed on the covering;

FIG. 8 is a view of the cutting tool in accordance with the invention to an enlarged scale and in section through a part of the table and of the panel or plate having the rough covering;

FIG. 9 is a perspective view of a prism adapted to be mounted on the guide rail of the device for milling out central apertures in circular workpieces;

FIG. 10 is a partial section through a tool in accordance with the invention for cutting out figures to templates;

FIG. 11 shows a drag device which can be mounted on the guide rail for milling curved shapes in thick workpieces;

FIG. 12 is a perspective view of the device showing an attachment for bevelling the edges of circular panels, and FIG. 13 shows an embodiment of the tool in accordance with the invention having a conical coil.

In the device in accordance with the invention shown in the drawings, a tool 1 having a fine-pitch coil is rigidly embedded, by sticking or soldering or pressing or screwing, preferably in a shank 2 whose diameter is at least 7 mm and which is longer than shaft 4 of driving motor 5, shaft 4 being in the form of a hollow spindle. If required, another tool protected by a cap 6 and visible in FIG. 3 can be disposed on the other end of shank 2. At the bottom end of shaft 4 is a clamping screw 7 which serves to clamp the shank 2 and thus secure the same axially and against rotation. To ensure satisfactory clamping without damage to the shank surface, the shank regions concerned have facets 3 (FIG. 3).

Tool 1 extends out of table 8 to any desired adjustable extent; the relatively large opening 9 in table 8 can be so covered by interchangeable panels or the like 10 corresponding to tool diameter that preferably a gap of just a few tenths of a millimeter is left between the apertures in the plate 10 and the tool, to prevent break-outs in the cutting of relatively soft woods and in particular plywood.

The motor which is suspended pivotally below table 8 and which to ensure minimum noise and wear and therefore maximum reliability is preferably a two-pole induction motor running at e.g. 2800 rpm can be pivoted to 45° forwards and backwards and can be located in any position; to locate the motor, the knurled nut 11 is slackened, the motor is set to the required position which can be red in angle degrees in a scale 12, and the nut 11 is then retightened. A marking 13 on the motor casing facilitates adjustment and reading. Table 8 is rigidly connected to a bearer 14 which can be seen in FIG. 2 and which has a clamping device 15 for securing the device e.g. to a workbench.

Preferably, the tool rotates clockwise in plan view; consequently, the workpiece fed on to the tool from the front tends to drift to the left and so the stop, if necessary, should be provided on the left of the tool. This is why the tool is disposed not at the centre of the table but to one side.

The table 8 is in shape preferably square so that the abutment 16 clampable to the table edge can be moved lengthwise and transversely. Accordingly, the table edge is provided all the way round with an inclination 17 in which correspondingly shaped clamping strips 18 of abutment or stop 16 engage. Operation of an eccentric lever 19 presses one of the strips 18 against table edge 17, the stop 16 being retained reliably in the selected position by the wedging action. Upon release of lever 19 the front strip 18 moves so far back that the stop 16 can be disengaged from the table and does not have to be removed by being moved laterally therealong.

As can be seen in FIG. 6, abutment 16 is formed on one side with the recess 20 of a height and width such that the tool is partly retracted into it in the inclined position when the abutment is placed transversely of the table and is pushed correspondingly far over the tool. In this position edges of workpieces 21 can be trimmed at any angle between 0° and 45°.

Table 8 is formed with a continuous groove 21 which can be seen in FIGS. 3 and 4*a* and in which a removable guide bar 22 slides easily. Bar 22 is a toothed rack whose toothing 23 engages with a pinion 24 concealed below the table surface and engaging in groove 22 and driven by a feed drive. Bar 22 is formed with a number of bores which may or may not be tapped and which are adapted to receive auxiliary devices and which have a handle 25 so that it can be used without the feed drive. As can be seen in FIGS. 4*a* to 4*c* to prevent the bar 22 from tilting out of the groove 21 there is a recess 26 at the end of the groove in the table, a magnet system which comprises a magnet 27, pole plates 28 and a pin 29 being rockingly disposed in recess 26. Because of the rocking suspension of the magnet system, the guide bar 22 can be raised in the front part of the table to disengage the teeth 23 from the pinion 24, a feature which is desirable when the position of the bar has to be altered rapidly without switching off the feed drive. In this case the magnet system sticks to the inclined guide bar just as reliably as in the lowered position.

A similar effect can be provided by means of a V-shaped or semicircular groove in the guide bar and a sprung ball at the end of the groove 21 in the table 8, the ball engaging in the guide bar groove; however, the magnetic facility is preferred since it experiences very little wear and is more reliable than the ball and groove system.

An eccentric clamping facility is provided at the table end so that the guide bar 22 can be located in any required position. Table 8 is formed with a recess 30 in addition to the recess 26 (? adjacent the recess 26 ?). The table part 31 between the recesses 26 and 30 is used as a clamping jaw, to which end a pin 32 which is disposed in such part and which, as can be seen in FIG. 4*b*, is dependent, is actuated by an eccentric 34 and alters its position and the position of the jaws 31 to clamp the bar 22 in the groove. Eccentric 34 is rotatably mounted in table 8 by means of a pin 33 and is actuated by handle 35.

Referring to FIGS. 4*a* and 5, the feed transmission is actuated by a clutchable crank 36, the gears of the transmission being so disposed that rotation of the crank 36 to the right moves the bar 22 forwards, the transmission ratio being such that one rotation of crank 36 corresponds to a feed of approximately 1 mm. An axially movable shaft 38 is mounted in transmission member 37, terminates at one end as a bevel gear 42 and is rigidly connected at its other end to the crank 36. A compression spring 38 is received in a recess 45 in member 37 and presses on the extension of crank 36. Shaft 38 is formed with a notch 40 in which a resilient wire hoop or the like 41 guided in a slot 44 in member 37 engages and therefore locates the shaft axially without impairment of its rotatability. In this position pinion 42 engages with bevel gear 43 rigidly secured to pinion 24 engaging in teeth 23 of guide bar 22. When hoop 41 is depressed manually and disengages from shaft 38, the spring 39 causes the crank 36 with the shaft 38 to move axially so that pinon 42 disengages from bevel gear 43. The guide bar 22 can then be moved manually without the relatively highly geared crank 36 co-rotating. To bring the bevel gears into correct engagement, the crank 36 is pressed in until the hoop 41 engages in notch 40. The member 37 protects the gears and other opertionally important elements of the transmission from dust or the like and damage, its bottom part being dished and completely covering the gears. Member 37 is also removable and is preferably secured to table 8 by means of a screw and two centring pins.

A description will now be given of a number of auxiliary facilities which co-operate with the guide bar 22 or stop 16 to enable a number of special functions to be performed.

FIG. 7 shows a facility which, with the use of the special properties of the tool in accordance with the invention, enables satisfactory geometrically straight cuts to be made rapidly and accurately. The facility comprises a panel or the like 46 which is preferably made of metal sheet or plate and which can be secured to the guide bar 22 just by being pushed on to the same by means of two pins which are disposed on the underside of the plate 46 and engaging corresponding bores in guide bar 22. Plate 46 is formed with a longitudinal groove 48 so disposed that tool 1 extends through groove 48 without touching its side walls. Preferably, groove 48 is from 0.2 to 0.3 mm wider than the diameter of tool 1.

The length of the plate 46 and groove 48 are preferably such that the length of the operative movement corresponds to the length of the operative movement of the guide bar 22.

Except for an edge of approximately 1 cm on the right and left and larger edges at the front and the back, the plate 46 has a rough covering 49 which can take the form of stuck-on emery cloth or paper or of a directly applied corundum surface or the like or which can be contrived by mechanical treatment of the plate surface by filing. Disposed at the right-hand and left-hand edges of the plate 46 are line markings which represent an angular division and enable workpieces which it is required to mitre to be aligned for the mitring cuts without the use of measuring devices.

So that workpieces marked with scores can be aligned very accurately in accordance with the required line of cut, the plate 46 has at both ends two unscrewable pillars or the like 50 around which a thin wire 51 is wound. Wire 51 is tensed by a tension spring 52 and forms a straight aiming or guiding line along the left-hand edge of groove 48 exactly above the actual line of cut of the tool, the height of the aiming line being varied as required by the wire 51 being moved on the pillars 50 and adapted to workpiece thickness, thus obviating parallax errors. Instead of the wire, a straight edge can be placed up against the pillars 50 and rest on the workpiece.

The pillars 50 are removable so as not to be a hindrance in the machining of workpieces larger than the plate 46.

The vertical cutting force which the tool transmits to the workpiece presses the same so strongly against the rough covering that normally a light hand pressure is sufficient for a cut in the solid through average-strength workpieces. To ensure that workpieces made of harder materials do not slip in the cutting direction, a support attachment 53 can be mounted at the front end of plate 46 in corresponding bores, the attachment 53 receiving, on the side near the tool, a pivoted jaw 54 on which a workpiece can bear in any required angular position.

To reduce the friction caused between the table 8 and the plate 46 by the cutting force, more particularly when the two parts are made of metal, the underside of the plate, as shown in FIG. 8, or the table can have a low-friction covering; for instance, the plate 46 can have a Teflon coating, a feature which also reduces scratching.

FIG. 8 is a sectional view to a very enlarged scale to show the arrangement of the tool relatively to the table and its action on a workpiece disposed on the plate 46 with a rough covering.

A workpiece 58 has already had a slot 59 cut in it by the tool 1, material being removed at place 60 of the workpiece by the tool. The free end thereof extends through an aperture 9 in table 8, aperture 9 being covered by plate 10 except for an opening adapted to tool diameter; if required, the cutting tool 1 can be adjusted in the direction of its axis 62 to cut grooves in workpieces. The table 8 or the tool 1 can be pivotable so that cuts can be made at an angle to the main planes in plane workpieces.

The plate 46 is disposed on the table, is connected to the guide bar 22 (not shown here) and can be moved rectilinearly therewith. The workpiece 58 sticks to the rough surface 49 on the plate 46. The underside thereof has a low-friction covering 57, e.g. in the form of a Teflon coating.

FIG. 9 shows another auxiliary feature. So that a central aperture in circular workpieces can be concentrically enlarged satisfactorily or so that cuts or grooves can be contrived concentrically of the periphery of a circle, a prism 55 is used which can be pushed on to guide bar 22 and whose distance from the tool 1 can be adjusted by movement of guide bar 22. The required adjustment can be set by clamping of the guide bar 22. The circular workpiece can then be pressed against the prism and turned manually in the opposite direction to tool rotation to cut the aperture to the required size concentrically of the outside diameter.

In an arrangement shown in FIG. 10 the tool 1 in accordance with the invention extends through a bore 61 in a tool table 8. Through the agency of adjusting means (not shown) the extent to which the tool projects from the table 8 can be varied. The workpiece 63 on which a template 64 is secured is disposed on table 8. The worm 1 has a non-screwthreaded zone 65 at its end. When workpiece 63 is so guided on table 8 in the direction indicated by arrow 66 that zone 65 is always in contact with edge 68 of guide 64, it is readily possible to cut in workpiece 63 a slot whose width corresponds to tool diameter and which has the same shape as edge 68. The underlying idea of the invention in this case resides in that the tool can be guided without mechanical or other means in a main direction indicated by the arrow 66 without forces arising which might endanger the person guiding the workpiece. No fixed guide in a direction perpendicular to the worm 1 is necessary for the workpiece 63 since the worm 1 does not apply appreciable forces to the workpiece in any direction perpendicular to its own axis.

The free end of the non-screwthreaded zone 65 of the cutting tool can have in known manner a drilling tip 69 for drilling a hole in a workpiece, for instance, so that a workpiece can be formed with a curved slot which does not have to extend as far as the workpiece edge and the workpiece being pressed down on to the tip 69 and to the table 8, the workpiece thus initially being formed with a simple aperture which can subsequently be amplified into a slot of any length by the workpiece being guided along template edge 68.

FIG. 11 shows a facility enabling curved cuts to be made, using the feed drive, in thick workpieces without the force normally required for hand feeding.

Secured to the rear end of guide bar 22 is a swing arm 70 but whose end a drag arm 71 is rockingly mounted for deflection to the right and to the left. The height of the drag arm 71, can be varied in adaptation to the workpiece thickness. At its free end the arm 71 has an entraining pin 72 which engages in a bore with which the workpiece will be formed. When the feed drive is operated through the agency of crank 36, guide bar 22 moves and draws workpiece 73 towards the cutting tool 1, the workpiece simultaneously being deflected manually in accordance with the pattern of the required curved line of cut into the required direction. In the example shown the cut is made along a line 74.

FIG. 12 shows a facility for cutting inclined surfaces on round or otherwise curved panel-like workpieces. A push-on guide member 75 is disposed on the stop 16, which is mounted transversely on table 8; guide element 75 is formed with a slot 76 which is of uniform width and terminates approximately 10 mm above the bottom edge of the member 75. A removable circular member 77 which has a pin 78 slides in slot 76 and has a notch whose dimensions are such that the circular member 77 can slide up and down and rotate in slot 76 without appreciable clearance.

To cut a bevel, the disc which is to be treated and whose central bore must coincide with the diameter of the pin 78 is pushed thereonto until abutting the plane surface of member 77 and is pushed downwards together therewith along slot 76 until bearing on table 8. A correspondingly dimensioned projection 79 of guide member 75 provides for the rearward support of the workpiece during cutting. After the cutting tool 1 has been adjusted to the required angle to the workpiece by inclination of the drive unit, the stop 16 with the facility and the workpiece 79 thereon, the latter being shown in partial section in FIG. 12, is moved towards the rotating tool until the required depth of cut has been reached. The abutment 16 is now clamped on the table and the disc is turned manually. The cutting force which is a special feature of the cutting tool in accordance with the invention and which acts substantially along the longitudinal axis of such tool ensures that the workpiece is pressed both against the table and also the rearward support projection 79, thus ensuring a clean cut.

FIG. 13 is an enlarged view of a conical cutting tool 1'. A feature of this embodiment is that cutting tool strength increases from the tool tip towards the motor, and so this tool can be used to make finer cuts in thin workpieces than in thick workpieces. To ensure that the edge of the cut is straight, the cutting tool is pivoted so that the cut edge of the workpiece also extends vertically.

The advantages of the device in accordance with the invention can be summarized as follows:

The advantageous possibilities and properties of various kinds of sawing, milling and planing are combined and in some cases even exceeded in a low-cost device, free from the disadvantages of the known facilities. Wood, plastics and even low-strength metal and other materials and parts of any awkward shape can, without adaptation or tool changing, be treated by removal of material by sawing or cutting or planing or smoothing satisfactorily and with a very good surface texture of the treated surface; the workpiece can safely be guided manually either freehand or along templates. Since the tool cannot catch in the workpiece, very fine freehand after cuts of a few hundredths of a millimeter thick can be made. If simple ancillary facilities, such as an adjustable stop, are used, very accurate parallel cuts can be made, and very accurate circle cuts can be made around a stationary pin or the like locatable at an adjustable distance from the cutting coil or worm or the like.

The risk of injury is reduced very considerably and is more particularly in comparably lower than from circular saws, band saws, millers and planers in the machining of small workpieces.

The drive is quiet since high speeds are not required. The coil removes material in virtual silence and produces fine curly chips, most of which drop under the table without being hurled aside by the tool, as with circular saws and planers. Virtually no dust is produced.

The description and drawings disclose in addition to the cutting tool 1 a number of facilities in accordance with the invention which lead in combination with the tool 1 to technical advantages, more particularly for home workshop and handicrafts use. These facilities are as follows:

The spindle 2 disposed in the hollow shaft 4 of motor 5, to which spindle the tool 1 is secured, the pivoted mounting of the motor, the special retention of the guide bar 22 in a groove 21 by means of a rectangular cross-section, magnetic location and a transmission drive 36, the plate 46 with the rough covering 49, the prism 55 for milling round workpieces, the drag facility 70, 71, the guides 75–79 for bevelling the edges of round members, the conical embodiment of the cutting tool 1' and the aiming or aligning aid 51. The invention relates to all these facilities.

I claim:

1. A machine for cutting materials such as wood and plastics, comprising a tool spindle, means for supporting said spindle for rotation, said spindle being adapted to be rotatably driven by a drive motor, a support table firmly connected to the spindle for supporting a workpiece to be cut, said table having an opening therein on the axis of said spindle, and a tool secured to said spindle and projectable through said opening in said table, said tool having at least one radially extending spiral rib formed on its outer periphery, the outer end of said rib being sharpened on its side which is adjacent to said table and said outer end thus forming a cutting edge, said spiral rib having a pitch within the range of from approximately 5° to approximately 15° relative to the axis of rotation of said spindle and said tool.

2. A machine for cutting materials such as wood and plastics, comprising a tool spindle, means for supporting said spindle for rotation, said spindle being adapted to be rotatably driven by a drive motor, a support table firmly connected to the spindle for supporting a workpiece to be cut, said table having an opening therein on the axis of said spindle, and a tool having a shank end secured to said spindle and said tool being projectable through said opening in said table to an adjustable length, said tool having at least one radially extending spiral rib formed on its outer periphery, the outer end of said rib being sharpened on its side which is adjacent to said table and said outer end thus forming a cutting edge, said spiral rib having a pitch within the range of from approximately 5° to approximately 15° relative to the axis of rotation of said spindle and said tool, said tool having a conical shape and widening toward said shank end.

3. A machine for cutting materials such as wood and plastics, comprising a tool spindle, means for supporting said spindle for rotation, said spindle being adapted to be rotatably driven by a drive motor, a support table firmly connected to the spindle for supporting a workpiece to be cut, said table having a guide groove therein, a guide rail adapted to be positioned in said groove, a supporting plate attached to said rail, said plate having a coarse coating on its top side and having an opening therein that extends parallel to said guide groove, said table having an opening therein on the axis of said spindle, and a tool secured to said spindle and projectable through said opening in said table, said tool having at least one radially extending spiral rib formed on its outer periphery, the outer end of said rib being sharpened on its side which is adjacent to said table and said outer end thus forming a cutting edge, said spiral rib having a pitch within the range of from approximately 5° to approximately 15° relative to the axis of rotation of said spindle and said tool.

4. A machine according to claim 1 or 2 or 3, wherein the pitch of said spiral rib is between 5° and 10° relative to the axis of the tool.

5. A machine according to claim 1 or 2 or 3, wherein the maximum diameter of said tool including the cutting edges is between 2 mm and 6 mm, and the pitch of said rib is approximately 8°.

6. A machine according to claim 1 or 2 or 3, wherein said spindle is pivotably connected to said support table and is generally in a plane that is perpendicular to the plane of said table, and further including means for holding said spindle in an adjusted swivel position.

7. A tool for cutting materials such as wood and plastics, comprising a shank adapted to be secured to a rotatable spindle, a cutting tool part formed on said shank and elongated in the direction of the axis of rotation of the spindle, said cutting tool part having at least one radially extending spiral rib formed on its outer periphery, the outer end of said rib being sharpened on its side which is adjacent to said shank and said outer end thus forming a cutting edge, said spiral rib having a pitch within the range of from approximately 5° to approximately 15° relative to the axis of rotation of said spindle, said cutting edges extending in a substantially straight line.

8. A tool according to claim 7, wherein said cutting tool part has a substantially conical shape, and the larger diameter end of said part is adjacent to said shank.

* * * * *